United States Patent [19]

Richards

[11] Patent Number: 4,745,638

[45] Date of Patent: May 24, 1988

[54] PASSIVE DISPENSER HAVING DELAYED DISCHARGE

[75] Inventor: Randall G. Richards, Madison, Conn.

[73] Assignee: The Drackett Company, Cincinnati, Ohio

[21] Appl. No.: 760,720

[22] Filed: Jul. 30, 1985

[51] Int. Cl.[4] ..... E03D 9/02

[52] U.S. Cl. ..... 4/228

[58] Field of Search ..... 4/227, 228

[56] References Cited

U.S. PATENT DOCUMENTS

| | | | |
|---|---|---|---|
| 1,144,525 | 6/1915 | Blake . | |
| 3,618,143 | 11/1971 | Hill et al. | 4/228 |
| 3,778,849 | 12/1973 | Foley | 4/228 |
| 4,171,546 | 10/1979 | Dirksing | 4/228 |
| 4,186,856 | 2/1980 | Dirksing | 222/424.5 |
| 4,216,027 | 8/1980 | Wages | 134/36 |
| 4,251,012 | 2/1981 | Owens et al. | 222/185 |
| 4,281,421 | 8/1981 | Nyquist et al. | 4/228 |
| 4,305,162 | 12/1981 | Cornelisse, Jr. et al. | 4/228 |
| 4,307,474 | 12/1981 | Choy | 4/228 |
| 4,396,522 | 8/1983 | Callicott et al. | 252/163 |
| 4,432,102 | 2/1984 | Woodruff et al. | 4/228 |
| 4,435,857 | 3/1984 | Meloy | 4/228 |
| 4,438,534 | 3/1984 | Keyes et al. | 4/228 X |
| 4,451,941 | 6/1984 | Gray | 4/228 |
| 4,485,500 | 12/1984 | Melville, Jr. | 4/228 |
| 4,507,811 | 4/1985 | Buelow et al. | 4/225 |
| 4,507,812 | 4/1985 | Dubois et al. | 4/228 |
| 4,558,471 | 12/1985 | Brown et al. | 4/228 |

FOREIGN PATENT DOCUMENTS

| | | |
|---|---|---|
| 23092 | 12/1984 | Australia . |
| 0115096 | 8/1984 | European Pat. Off. . |
| 3315873 | 10/1984 | Fed. Rep. of Germany . |
| 2090884 | 7/1982 | United Kingdom . |

*Primary Examiner*—Charles E. Phillips

*Attorney, Agent, or Firm*—Charles J. Zeller

[57] ABSTRACT

The dispenser of the present invention is adapted for placement in a body of liquid, a solution being contained in a vented product chamber of the dispenser, a predetermined volume of said solution being discharged into the body of liquid in response to a lowering of the level of the body of liquid from a first elevation to a second elevation and through a discharge means establishing fluid communication between said product chamber and the body of liquid. In accordance with the present invention, the vent means for the product chamber comprises an inverted U-shaped conduit extending upwardly above the top of the product chamber and hydraulic means adapted to delay the onset of discharge of solution from the product chamber to the body of liquid.

13 Claims, 4 Drawing Sheets

PASSIVE DISPENSER HAVING DELAYED DISCHARGE

FIELD OF INVENTION

The present invention relates to a passive dispenser, adapted for placement in a body of liquid, for dispensing materials such as toilet bowl cleaners, e.g., disinfectants, detergents, fragrances, and the like, in solution form from the dispenser in response to a lowering of the height of the body of liquid from a first (higher) elevation to a second (lower) elevation. More specifically, the dispenser of the present invention is adapted for placement in a toilet tank, the concentrated solution of cleaners in the dispenser being delivered to the toilet bowl during the flush cycle. Most specifically, the present invention relates to a passive dispenser designed to delay the dispensing of the concentrated solution into the body of liquid until the level thereof has fallen a finite distance, whereby the retention of solution in the toilet bowl is improved.

BACKGROUND OF INVENTION

Numerous devices for dispensing a cleaning and/or disinfectant solution into a toilet tank for flow into a toilet bowl when the tank is flushed are known. These devices can be characterized as active dispensers, wherein valves or other mechanisms are used to initiate flow from the dispenser when the toilet tank is emptied to a given level, or as passive dispensers, wherein no moving parts are employed, the discharge of a predetermined amount of solution from the dispenser being actuated solely by the lowering of the height of the water contained in the tank.

Exemplary of the former class, i.e., active dispensers, are devices described in U.S. Pat. Nos. 1,307,535 to Ciancaglini, 2,692,165 to Sinkwich, 3,341,074 to Pannutti, 3,698,021 to Mack, et al., 3,778,849 to Foley, 4,036,407 to Slone and 4,244,062 to Corsette. A disadvantage of these active-type dispensers is a tendency for the valve or other mechanical actuating means to become clogged, and thus fail in the open or closed position. Passive-type dispensers overcome this particular problem inasmuch as there are no moving parts that can fail to operate in the proper manner.

In one type of passive dispenser, the dispenser is alternatively flooded when the tank is filled and emptied, at least partially, by siphoning therefrom when the tank is flushed. For example, U.S. Pat. No. 650,161 to Williams, et al., discloses a dispenser comprising a product chamber, a vent extending upwardly from the top of the product chamber, and an inverted U conduit that operates to siphon the concentrated solution of disinfectant from said chamber when the tank is emptied. The Williams, et al., device is intended to reside at the bottom of the tank, the outlet of the inverted U conduit being proximate thereto. U.S. Pat. Nos. 969,729 to Smith, 1,144,525 to Blake, and 1,175,032 to Williams, et al., and British Pat. Nos. 10,110 (1907) to Holloway, 21,253 (1908) to Berry and 11,469 (1890) to Fleuss each disclose dispensers adapted to withdraw a given volume of solution from the product chamber through a siphon conduit in response to a lowering of the tank liquid level.

Each of the dispensers described above are in the form of a jar, bottle, or other container that resides at the bottom of the tank. It is preferred, however, for the convenience of the user, to provide a toilet tank dispenser adapted for suspension from the rim of the tank. For example, U.S. Pat. No. 2,839,763 to Newsom shows a passive dispenser attached to the rim of a toilet tank, the rising tank water causing disinfectant to be dispensed into the tank water. In the present invention, however, the disinfectant is dispensed into the tank water upon a lowering of the level of same, the objective being to maximize retention of the concentrated cleaning solution, although in diluted form, in the bowl of the toilet.

U.S. Pat. No. 4,438,534 to Keyes, et al. discloses a passive dispenser adapted to codispense a concentrated detergent solution and a concentrated disinfectant solution from separate product chambers, and preferably is further adapted to be suspended from the rim of the toilet tank. A disadvantage with the dispenser of the Keyes, et al. patent when same is suspended from the tank rim is that solution issuing from the product chambers commences with the tank water level substantially above the bottom of the tank. Hence, a portion of the solution thus released is not retained in the toilet bowl, but rather is carried through the bowl to the sewer.

U.S. Pat. No. 4,305,162 to Cornelisse, Jr., et al., discloses a toilet tank dispenser adapted for suspension from the tank rim and of the type wherein an air lock is formed in the siphon conduit, which dispenser is an improvement of the dispenser disclosed in U.S. Pat. No. 4,208,747 to Dirksing. According to Cornelisse, Jr., et al., product solutions at times ought to be discharged at a relatively slow rate, and it would thus be possible that the tank would begin to refill with water prior to completion of the discharge operation. If the tank refilled up to the inlet/discharge port of the siphon tube before completion of discharge, there would be no way of forming the air bubble required to obtain the air lock in the siphon tube. Cornelisse, Jr., et al., retards discharge of the solution from the dispenser by enlarging the lower end of the longer leg of the siphon tube and providing a properly sized orifice therein that communicates with the tank water. In the discharge cycle an air bubble is retained within the lower end of the longer leg, which air bubble is available to form the air lock should the tank water rise above the leg before all solution has drained therefrom.

While this construction of Cornelisse, Jr., et al. will retard flow of solution from the dispenser, it does not prevent flow from starting as soon as the tank water level has fallen to below the upper vent means proximate the top of the dispenser. Hence, the concentrated solution is dispensed into the tank water as the level passes through essentially the entire height of the dispenser, a portion of which passes through the bowl and is ineffectual. Furthermore, the improvement disclosed in the Cornelisse, Jr., et al., patent is not very effective in the case of low viscosity and/or low surface tension solutions inasmuch as that improvement does not control the onset of dispensing, but rather the rate of dispensing.

U.S. Pat. No. 3,778,849 to Foley describes an active dispenser which considers the problem of dispensing product solution late in the flush cycle. The Foley dispenser comprises a product chamber, a first conduit entering the product chamber, and a second conduit in fluid communication with the first conduit. The upper end of the first conduit is proximate with the top of the dispenser and is provided with a first check valve to permit air to leave but not enter the conduit, while the lower end of the first conduit is in the body of liquid and is provided with a U-bend having a second check valve that permits liquid to leave but not enter the conduit. Fluid communication between the first conduit and the product chamber is provided by means of an orifice proximate the bottom of the product chamber. The second conduit, which is above the orifice and extends downwardly a substantial distance into the body of liquid, provides fluid communication between the product chamber and the body of liquid.

As with many active dispensers, failure of the check valves may occur. A second disadvantage is that the Foley dispenser requires a conduit that extends far into the tank. Accordingly, a single device is not suitable for placement in the myriad of tank styles and sizes available.

SUMMARY OF INVENTION

It is an object of the present invention to provide an in-tank toilet dispenser adapted to discharge a concentrated cleaning and/or disinfectant solution into the tank water when the toilet is flushed.

It is a further object to provide a toilet dispenser suspendible from the rim of the toilet tank.

It is a primary object of the present invention to optimize the concentration of the cleaning and/or disinfectant agent retained in the bowl water upon completion of the flush of the toilet.

In accomplishment of the primary objective, it is an object of the present invention to delay the onset of discharge of solution from the dispenser.

These and other objects and advantages of the present invention will be more fully understood upon a reading of the Detailed Disclosure, a summary of which follows:

The dispenser of the present invention is adopted for placement in a body of liquid, a solution being contained in a vented product chamber of the dispenser, a predetermined volume of said solution being discharged into the body of liquid in response to a lowering of the level of the body of liquid from a first elevation to a second elevation and through a discharge means providing fluid communication between the product chamber and the body of liquid. In accordance with the present invention, the vent means for the product chamber comprises an inverted U-shaped vent conduit extending upwardly above the top of the product chamber, the vent and hydraulic means adapted to delay the onset of discharge of solution from the product chamber to the body of liquid.

Preferably, the discharge pathway further serves as the inlet pathway to permit liquid to enter the product chamber during raising of the level of the body of liquid from said second elevation to said first elevation, the combined inlet/discharge pathway preferably providing siphoning of solution from the product chamber during discharge thereof.

In a particularly preferred embodiment of the present invention, the hydraulic means included in the vent conduit is a reservoir means associated with the outlet end of the vent conduit, most preferably said reservoir means being a cuplike reservoir having a volume greater than the volume of the vent conduit.

DETAILED DESCRIPTION OF THE PREFERRED EMBODIMENTS

The efficiency of dispensers adapted to discharge a predetermined volume of concentrated cleaning or disinfectant solution into the tank water of a flush toilet during the flush cycle is a function of the amount of said solution actually retained in the bowl water of the toilet after the flush is completed. In studying the dynamics of toilet operation, it has been found that typically between about 10 to about 30% of the tank water is retained in the bowl after the flush, and that between zero to about 15 percent of the tank water remains in the tank after the flush and prior to the onset of the refilling cycle.

For dispensers suspended from the rim of the tank proximate the full liquid level, it has been observed that discharge of the concentrated cleaning or disinfectant solution, for a majority of the models of toilets in common use, occurs prematurely, and that efficiency may be improved by delaying the commencement of discharge from the dispenser. By delaying discharge of solution, and for the majority of the models of toilets in common use, at least a major portion of the concentrated cleaning or disinfectant solution discharged from the dispenser is retained in that portion of the tank water retained in the toilet bowl.

The dispensers of the present invention comprise a product chamber, conduit means for tank water to enter the dispenser during filling of the tank and for said solution to leave the dispenser during emptying or flushing of the tank, vent means including hydraulic means to delay discharge of concentrated solution from said product chamber, and means to suspend the dispenser from the rim of the tank. A cake, tablet, extrudate, or other form of a cleaning or disinfectant material is contained in the product chamber, which material forms, upon dissolution, the concentrated cleaning or disinfectant solution that is discharged each time the tank is flushed.

Figure 1:
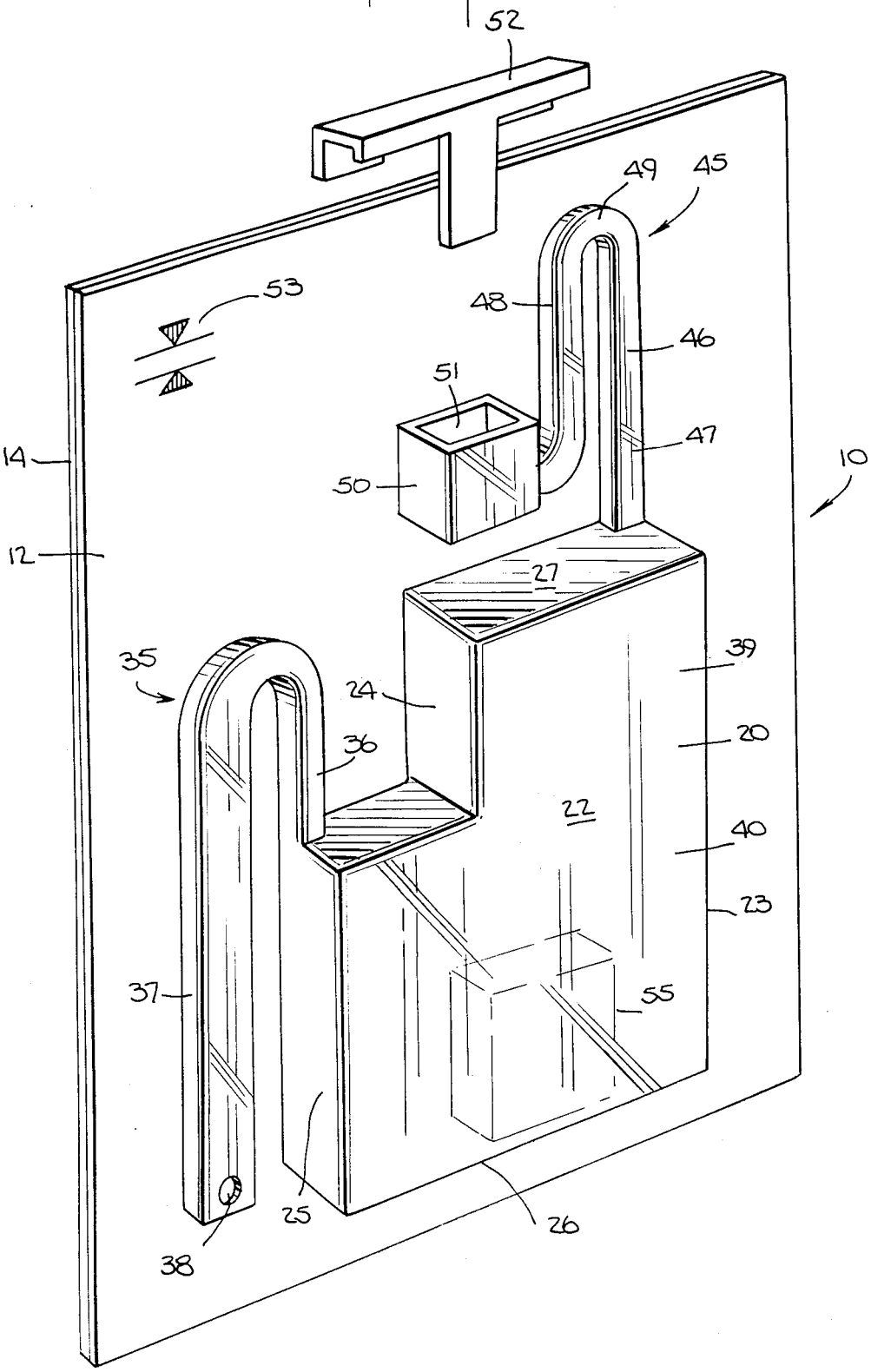
FIG. 1 is a perspective view of the dispenser of the present invention.
Figure 10:
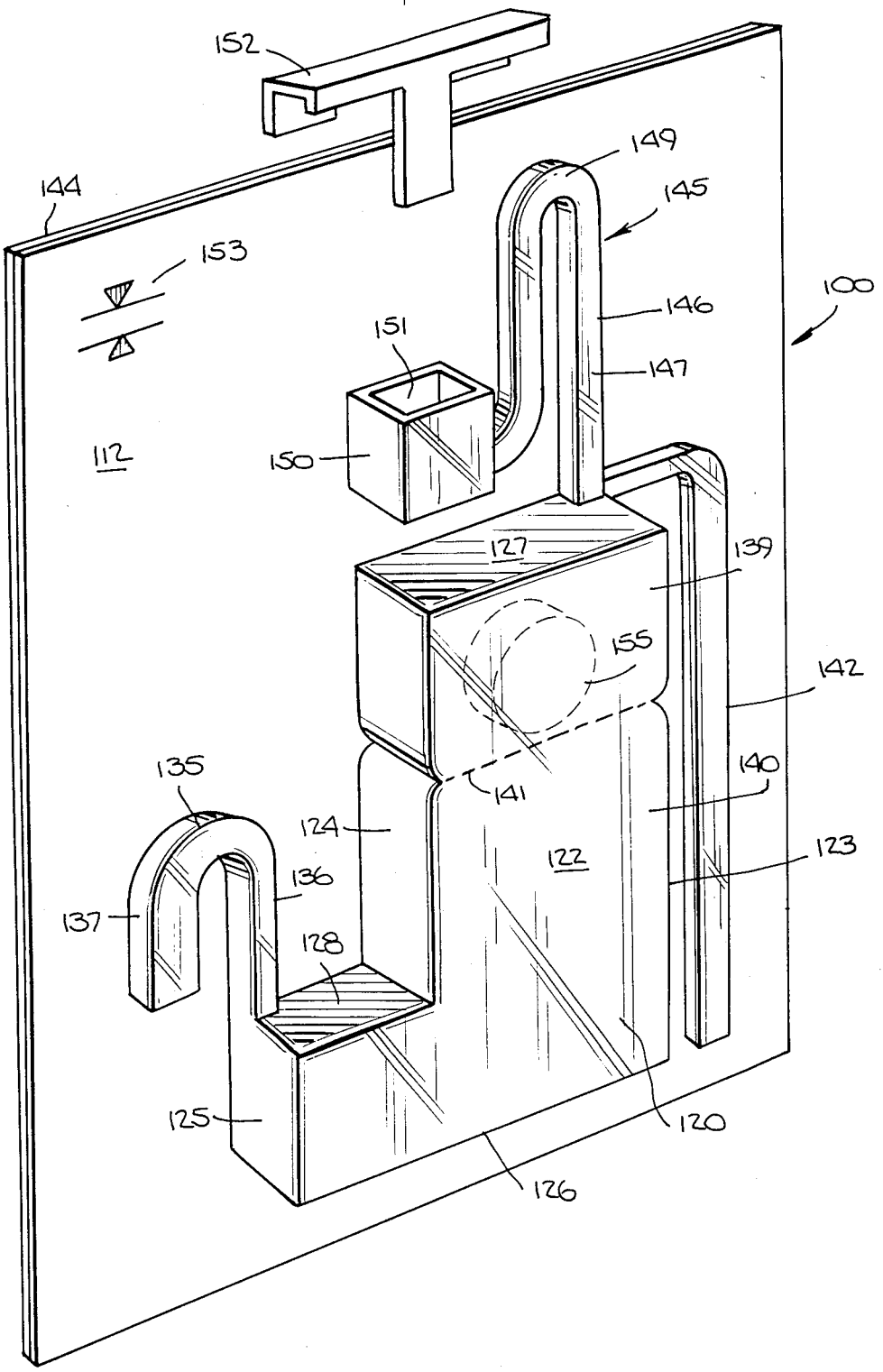
FIG. 10 is a perspective view of an alternate embodiment of the dispenser of the present invention.

In FIG. 1 there is shown a preferred embodiment 10 of the present invention that is adapted for siphon discharge of the concentrated cleaning or disinfectant solution from the product chamber to the tank water during the flush cycle of the toilet, while in FIG. 10 is shown a preferred embodiment that is adapted for gravity discharge.

Referring to FIG. 1, the dispenser 10 is preferably fabricated from two sheets of plastic material, the first sheet 12 being molded, for example, by thermoforming, to provide the product chamber and conduits of the dispenser, and a second sheet 14 being sealed as a backing sheet to said first sheet 12.

In the dispenser 10, the product chamber 20 is formed by front wall 22, sidewalls 23, 24 and 25, bottom wall 26, top wall 27, wall segment 28, and a rear wall, not shown, which is a portion of the backing sheet 14. A water-dissolvable cake, tablet, extrudate, or other form of material 55 containing the cleaning or disinfectant agent is contained in the product chamber 20. U-shaped siphon conduit, designated generally by numeral 35, comprises an interior, short leg 36 that enters the product chamber 20 at the wall segment 28 and an exterior, long leg 37 that extends to below the wall segment 28, and which is provided with an aperture 38 proximate the bottom thereof for the passage of liquid. It is seen that wall segment 28 divides the product chamber 20 into an upper portion 39 and a lower portion 40, the volume of the upper portion 39 being essentially equal to the predetermined volume of solution dispensed from the product chamber 20. Extending upwardly from the top wall 27 of the product chamber 20 is a vent means, designated generally by numeral 45, the vent means 45 including hydraulic means to delay the onset of dispensing of solution from the product chamber. The vent means 45 shown in FIG. 1 comprises an inverted U-shaped conduit 46 including a first leg 47 extending upwards from the top wall 27 of the product chamber 20, a second leg 48, and a U-bend portion 49 connecting said first leg 47 and said second leg 48, and a cuplike reservoir 50 extending laterally outward of the second leg 48, said cuplike reservoir 50 having an open end 51 providing fluid communication between the leg 48 and the tank in which the dispenser 10 resides.

Also as shown in FIG. 1, the dispenser 10 includes adjustable hanging means 52 to suspend the dispenser 10 from the rim of the toilet tank and indicia 53 that designates the placement of the dispenser relative to the high water level of the tank, i.e., the static water level between flushes. The hanging means may be of the type disclosed in U.S. Pat. No. 4,455,692 to Hegge, et al., incorporated herein by reference thereto.

The operation of the dispenser is next described in conjunction with FIGS. 2 to 9, schematic drawings of the dispenser 10. In this series of drawings, the tank and the hanging means have been omitted.

Figure 2:
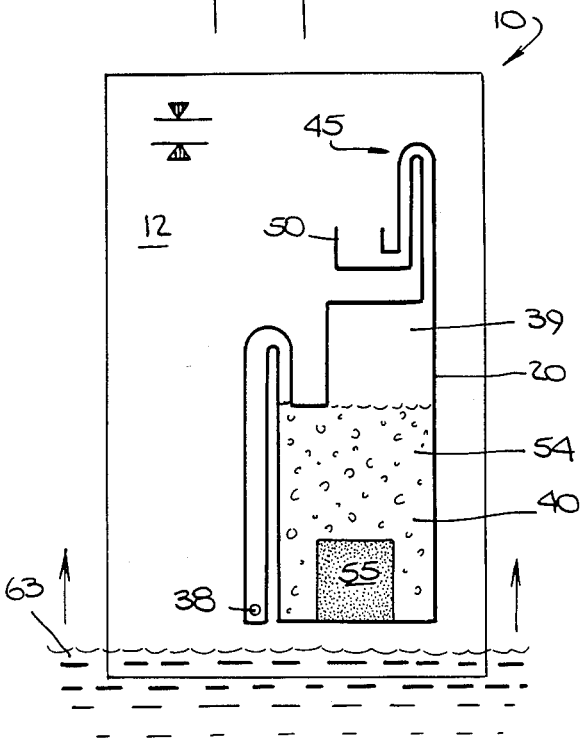
FIGS. 2–9 are schematic cross-sectional front views of the dispenser of FIG. 1 illustrating its operation.

In FIG. 2 the dispenser 10 is shown just after the flush and as the water level 63 is rising to refill the tank. It is seen that the lower portion 40 of the product chamber 20 contains a residual (undispensed) quantity of concentrated solution 54 formed by dissolution of the tablet 55 contained therein. It is also seen that the upper portion 39 of the product chamber 20 is empty, the volume of concentrated solution contained therein having previously been dispensed.

Figure 3:
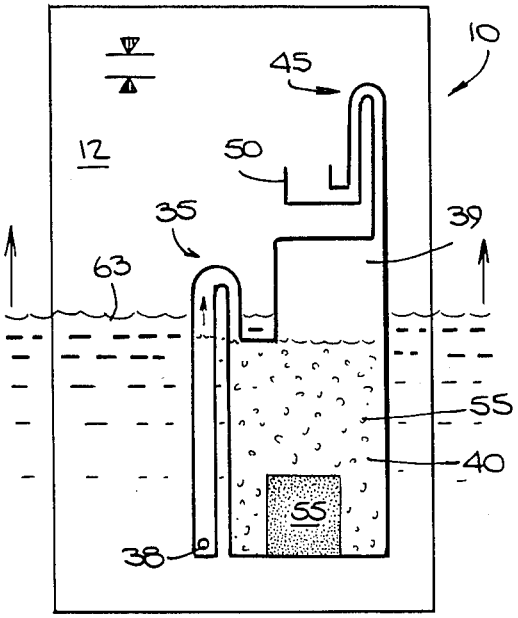
Figure 4:
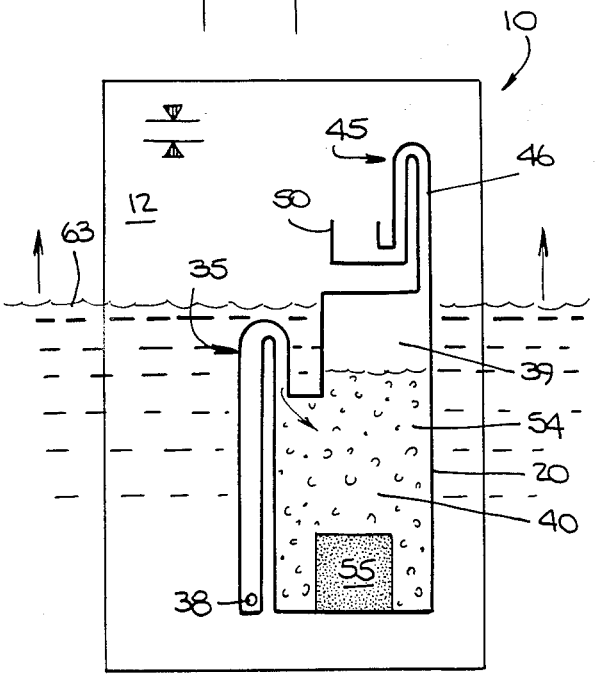
Figure 5:
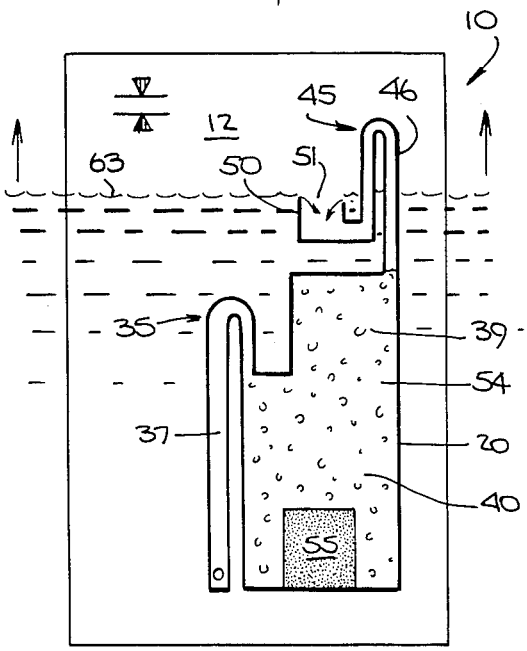
Figure 6:
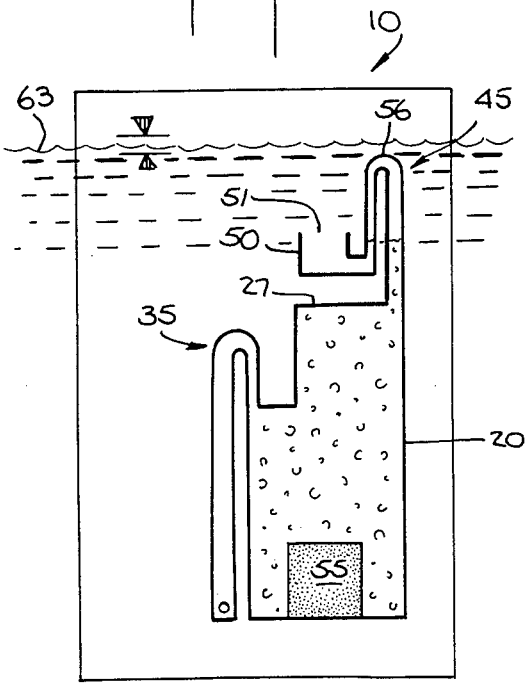

In FIG. 3 the water level 63 has risen to proximate midway the height of the dispenser. Water has entered exterior leg 37 through aperture 38, and is at a slightly lower level than water level 63 in the tank. Solution 54 is at the same level as in FIG. 2. In FIG. 4 the tank water level 63 is just below the top wall 27 of the product chamber 20, and the upper portion 39 of the product chamber 20 has filled partially with water entering through the siphon conduit 35. Tank water entering the product chamber 20 gradually dissolves an amount of the cleaning or disinfectant cake 55, and the solution 54 ultimately achieves an equilibrium concentration. In FIG. 5 the tank water level has risen above the open top 51 of the cuplike reservoir 50 and fills the reservoir, thereby trapping air in the vent conduit 46. FIG. 6 shows the dispenser during the quiescent period between flushes, an air bubble 56 residing in the vent conduit 46. Although the water level 63 is shown in FIG. 6 above the top of the vent conduit 46, this is not critical to the operation of the unit.

Figure 7:
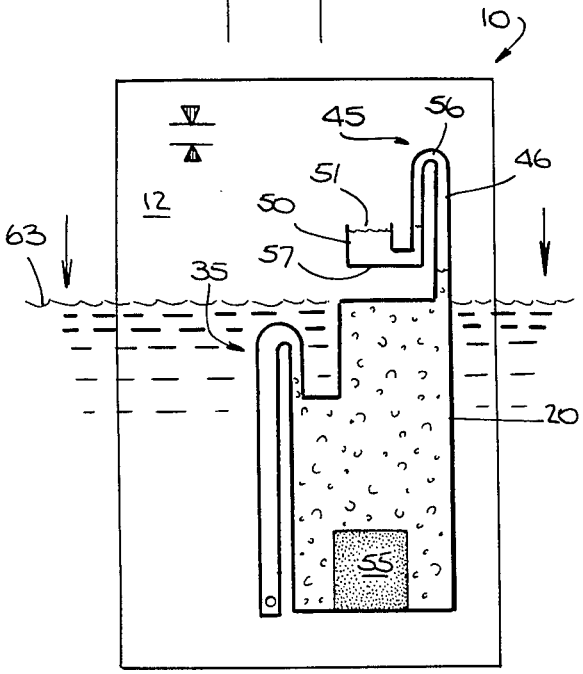
Figure 8:
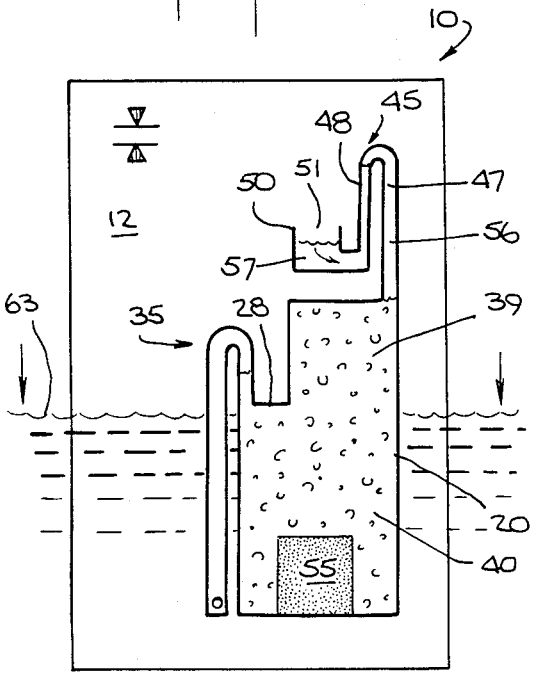

FIGS. 7–10 illustrate the operation of the dispenser during the flush of the tank. In FIG. 7 the water level 63 in the tank has dropped to about the top wall 27 of the product chamber 20.

Figure 9:
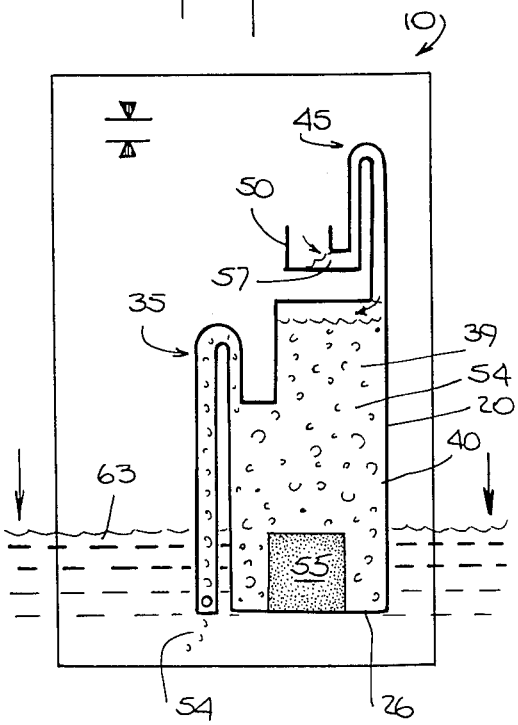

The changing tank water level between FIGS. 6 and 7 would, if the dispenser were not provided with reservoir 50, cause a slow, continuous discharge of solution from the product chamber 20. In the dispenser 10, as shown in FIG. 7, however, there is insufficient pressure differential between the interior of the dispenser and the atmosphere to displace the water trapped in the cuplike reservoir 50. (Water 57 in reservoir 50 begins to rise in leg 48 of vent conduit 46, in view of a slight pressure differential, as shown in FIG. 7.) Consequently, essentially no discharge of solution occurs. Similarly, in FIG. 8, where the tank water level 63 has dropped to just below wall segment 28, essentially no discharge has taken place. In FIG. 9 the tank water level 63 has dropped to proximate the bottom wall 26 of the product chamber, and the hydrostatic head is seen to be sufficient to begin substantial displacement of the water 57 from reservoir 50 and solution 54 from product chamber 20. After the water 57 has been discharged through the vent means 45, solution 54 is dispensed through siphon conduit 35 and at a faster flow rate than would be otherwise, in view of the greater hydrostatic head which has been allowed to develop. After solution 54 has been discharged from the dispenser 10, the upper portion 39 of the product chamber 20 is empty, although a volume of solution 54 remains in the lower portion 40. The condition of the dispenser after the flush is shown in FIG. 2, wherein the tank water level 63 is again beginning to rise. The upper portion 39 of the product chamber has been evacuated, the solution having been dispensed into the tank water.

It is seen that the reservoir 50 delays discharge of solution 54 until the level of the tank water has dropped substantially. By delaying discharge, the major portion of solution 54 is ultimately dispensed into the volume of tank water that is retained in the bowl, as opposed to dispensing a major portion of solution into a volume of tank water that passes through the bowl into the sewer. Moreover, by reducing the volume of tank water into which the solution is dispensed, there is less dilution of the concentrated solution 54. Finally, delay in dispensing permits rapid dispensing of the solution 54, with the consequence of optimizing delivery into a smaller volume of tank water. Hence, there is less likelihood of diluting the concentrated solution in tank water.

It should be understood that the improvement in dispenser operation contemplated by the present invention is not intended as an optimization of dispenser efficiency with respect to any particular make of toilet. Rather, the delay in dispensing will improve dispensing efficiency in a majority of toilets in general use, but will not maximize efficiency for each model. It is also recognized that for a small number of toilet models in use there may be a loss in dispensing efficiency.

Referring to FIG. 10, the dispenser 100 is adapted for gravimetrically dispensing a cleaning or disinfectant solution from the product chamber 120 to the tank water, in accordance with the principles disclosed above in connection with the embodiment 10 of FIG. 1.

The dispenser 100 is preferably fabricated from two sheets of plastic material, as with embodiment 10 described above. However, the method of construction is not critical to the present invention.

In the dispenser 100, the product chamber 120 is formed by front wall 122, sidewalls 123, 124 and 125, bottom wall 126, top wall 127 and a rear wall, not shown, which is a portion of the backing sheet 114. The product chamber 120 comprises an upper portion 139 and a lower portion 140, there being, optionally, a baffle or constriction 141 therein between. The purpose of the baffle 141 is to provide a support for the cleaner or disinfectant cake 155, if it is desired to have the cake in the upper portion 139. Alternatively, the cake may be provided at the bottom of the lower portion 140 of the product chamber.

Extending upwardly from the top wall 127 of the product chamber 120 is a vent means 145 including a vent conduit 146 and hydraulic means to delay the onset of dispensing of solution from the product chamber 120. The vent conduit 146 is essentially identical to the vent conduit 46, and the same identifying numerals of FIG. 1, prefixed by a "1" are used in FIG. 10 to designate its elements.

Fill means, shown in FIG. 10 as the conduit 142 depending from the bottom of leg 147 of vent conduit 146, is provided proximate the top 127 of the product chamber 120. An inverted U-shaped outlet conduit 135 is provided proximate the bottom of lower portion 140 of product chamber 120. The conduit 135 has an upwardly extending interior leg 136 in fluid communication at its lowermost end with the lower chamber 140, and in fluid communication at its uppermost end with downwardly depending exterior leg 137, which is in fluid communication at its lowermost end with the tank water. Indicia 153 and hanger means 152 are provided as in embodiment 10 of FIG. 1. The volume of leg 137 is greater than the volume of conduit 142, for reasons discussed below.

Operation of the dispenser 100 is similar in concept to dispenser 10 operation. When the tank is full just prior to a flush, the reservoir 150 is filled with water and the conduit 146 is partially liquid filled, there being air entrapped in the top portion 149 thereof. Similarly, the conduit 135 is partially liquid filled, there being air entrapped in the uppermost portion thereof.

Initially, the lowering of the tank water level has essentially no effect in the discharge of solution from the product chamber. When the tank water level reaches a height such that the pressure differential between the atmosphere and the inside of the product chamber 120 is sufficient to force the water in reservoir 150 through the conduit 146, dispensing through conduit 135 begins. In order to keep the solution from dispensing prematurely, it is necessary for the fill conduit 142 to extend below the uppermost portion of the conduit 135, preferably to extend downwardly to proximate the bottom wall 126 of the product chamber.

As the tank water rises after the flush, water enters leg 137 of conduit 135 and also conduit 142. Because the volume of leg 137 is greater than the volume of conduit 142, notwithstanding the relative heights thereof, tank water enters the product chamber from the top through conduit 142, thereby forming the air lock in conduit 135. When the tank water level rises to the height of the reservoir 151, the reservoir 151 is again filled, and the air lock in the conduit 146 again formed.

I claim:

1. In a dispenser adapted for placement in a body of liquid and wherein a quantity of solution is contained in a vented product chamber of said dispenser, a predetermined volume of said solution being discharged therefrom in response to a lowering of the level of said body of liquid from a first elevation to a second elevation, the solution being discharged through discharge means providing fluid communication between said product chamber and said body of liquid, the improvement comprising product chamber vent means including an inverted U-shaped vent conduit extending above the top of said product chamber and including hydraulic means adapted to delay the onset of discharge of solution from the product chamber to the body of liquid through the discharge means, said hydraulic means being reservoir means in fluid communication with the outlet end of the vent conduit.

2. The dispenser of claim 1 wherein the discharge means is an inlet/discharge siphon conduit entering the product chamber at a point below the vent means.

3. The dispenser of claim 2 wherein the discharge of solution from the siphon conduit into the body of liquid is through an aperture proximate the bottom of the siphon conduit.

4. The dispenser of claim 1 or 2 wherein the reservoir means is a cuplike reservoir.

5. The dispenser of claim 1 or 2 wherein the product chamber contains a water-soluble cake forming, upon dissolution, said solution.

6. The dispenser of claim 1 or 2 wherein the volume of the reservoir means is greater than the volume of the vent conduit.

7. The dispenser of claim 1 wherein the dispenser further comprises a fill conduit entering the dispenser above the discharge means.

8. The dispenser of claim 7 wherein the discharge conduit is an inverted U-shaped conduit.

9. The dispenser of claim 8 wherein the leg of the inverted U-shaped discharge conduit adjacent the body of liquid has a larger volume than that of the fill conduit.

10. The dispenser of claim 9 wherein the reservoir means in fluid communication with the outlet end of the vent conduit is a cuplike reservoir.

11. The dispenser of claim 7 or 9 wherein the volume of the reservoir means is greater than the volume of the vent conduit.

12. The dispenser of claim 11 wherein the fill conduit enters the vent conduit proximate the top of the product chamber and extends downwardly to below the discharge point of the inlet/discharge conduit.

13. The dispenser of claim 1, 2 or 7 wherein the product chamber contains a water-soluble cake forming, upon dissolution, said solution.

* * * * *